United States Patent [19]

Black

[11] 4,201,185

[45] May 6, 1980

[54] METHOD AND MEANS FOR HEATING BY WOOD BURNING

[76] Inventor: Milton W. Black, Box 64, Gibbon, Minn. 55335

[21] Appl. No.: 935,370

[22] Filed: Aug. 21, 1978

[51] Int. Cl.[2] ..... F24C 1/14; F24B 5/00; F23M 7/00

[52] U.S. Cl. ..... 126/77; 110/175 R; 126/15 R; 126/67; 126/83; 126/110 E; 126/112; 126/193

[58] Field of Search ..... 126/112, 77, 15 R, 66, 126/67, 83, 193, 110 E; 110/72, 175 R

[56] References Cited

U.S. PATENT DOCUMENTS

| | | | |
|---|---|---|---|
| 119,949 | 10/1871 | Perry et al. | 126/193 |
| 410,391 | 9/1889 | West | 126/193 |
| 626,280 | 6/1899 | Horspool et al. | 110/175 R |
| 1,432,835 | 10/1922 | Burkart | 110/175 R |
| 1,644,900 | 10/1927 | Sperry | 126/77 |
| 1,663,937 | 3/1928 | Ehrlich | 126/77 |
| 2,345,519 | 3/1944 | Wingert | 126/77 |
| 2,864,358 | 12/1958 | Harding | 126/77 |
| 4,111,181 | 9/1978 | Canney | 126/77 |
| 4,136,662 | 1/1979 | Willson | 126/77 |
| 4,140,101 | 2/1979 | Glover | 126/77 |

*Primary Examiner*—James C. Yeung
*Assistant Examiner*—Daniel J. O'Connor
*Attorney, Agent, or Firm*—Zarley, McKee, Thomte, Voorhees & Sease

[57] ABSTRACT

The wood burning heating means of the present invention utilizes a firebox having a grate adjacent the lower end and a flue opening adjacent the upper end thereof. A baffle is positioned immediately below the flue opening in such a manner as to deflect rising hot gases prior to their exit through the flue opening. A main draft opening provides communication of air below the grate to provide oxygen for the fire. A secondary draft opening is provided above the grate for introducing air in such a manner that oxygen will be provided immediately below the baffle to facilitate combustion of the gases which have accumulated adjacent the baffle.

11 Claims, 6 Drawing Figures

METHOD AND MEANS FOR HEATING BY WOOD BURNING

BACKGROUND OF THE INVENTION

This invention relates to a method and means for heating by wood burning.

Conventional wood burning stoves or furnaces generally include a fire box having a main draft for introducing air below the grate in the bottom of the fire box and additionally having a flue outlet opening adjacent the upper end thereof.

A problem commonly encountered with conventional wood burning stoves and furnaces arises from the fact that often the tars and other ingredients from the wood are not completely burned prior to their exit through the flue opening. This results in accumulation of tar and pitch within the flue and chimney, thereby creating a fire hazard. Furthermore, these conventional wood burning stoves and furnaces are not as efficient as they could be since not all of the wood is burned to produce heat.

SUMMARY OF THE INVENTION

The present invention utilizes a fire box having a baffle plate located immediately below the flue opening in such a manner as to deflect and divert the rising gases within the fire box prior to their exit through the flue opening. This baffle thus creates an accumulation of the hot rising gases immediately below the baffle plate which causes a hot spot to occur immediately below the baffle plate which is slightly hotter than the temperature in the remainder of the fire box.

Heat alone, however, is not sufficient to provide full combustion of the gases which accumulate below the baffle plate. Oxygen must also be provided, and this is done by a secondary draft opening which is located above the grate, and which introduces air into the fire box in such a manner that the air is drawn toward the hot spot located immediately below the baffle plate. This oxygen facilitates the combustion of the gases which are located at this hot spot and results in more complete combustion of the gases prior to their exit from the flue. It has been found that temperatures of approximately 1150° F. or slightly higher are achieved below the baffle plate, and this temperature results in combustion of gases, pitch and tar, thereby leaving a cleaner chimney with less chance of chimney fire.

In order to prevent smoke from exiting through the secondary draft opening, a smoke damper is provided in covering relation over the secondary draft opening so as to cause the air entering through the secondary draft opening to move downwardly below the lower edge of the smoke damper prior to entry into the fire box.

Another advantage is obtained by virtue of the arrangement of the firebox with respect to the outer housing of the furnace. The furnace housing is spaced outwardly from the walls of the fire box in such a manner to provide an air circulation chamber around the bottom, rear, top and opposite sides of the fire box. This air circulation chamber increases the efficiency of heat exchange from the fire box to the air within the circulation chamber for circulation throughout the building to be heated. A fan forces further air circulation through the circulation chamber and outwardly through a hot air exhaust at the top of the furnace. A thermostat is mounted within the circulation chamber to control the actuation and deactuation of the fan in response to varying temperatures within the circulation chamber.

A further advantage is achieved by having the flue extend through the circulation chamber before entering the chimney. This permits heat to radiate from the flue into the circulation chamber where it is circulated throughout. The ventilation system thereby increasing the efficient use of heat which normally would go up the chimney.

A second bimetal spring thermostat is provided within the circulation chamber and is connected to a main draft control which causes selective opening and closing of the main draft to control the speed with which the fire burns within the fire box.

Therefore, a primary object of the present invention is the provision of an improved method and means for heating by wood burning.

A further object of the present invention is the provision of a wood burning furnace which causes more complete combustion of the wood and the tars within the wood prior to the exit of the combusted gases through the flue opening.

A further object of the present invention is the provision of a method and means which minimizes the accumulation of tars and other impurities in the flue opening so as to minimize the fire hazard therein.

A further object of the present invention is the provision of a method and means which maximizes the heat achieved per unit of wood burned therein.

A further object of the present invention is the provision of a method and means which maximizes the heat exchange between the fire box and the circulation chamber which holds the air being circulated throughout the building to be heated.

A further object of the present invention is the provision of a method and means which provides a secondary draft opening for providing oxygen to the upper interior portion of the firebox.

A further object of the present invention is the provision of a method and means which prevents the exit of smoke through the secondary opening while at the same time permitting the entry of air through the secondary opening so as to provide oxygen and improve the combustibility of the gases within the fire chamber.

A further object of the present invention is the provision of a device which is economical to manufacture, durable in use and efficient in operation.

DETAILED DESCRIPTION OF THE DRAWINGS

Figure 1:
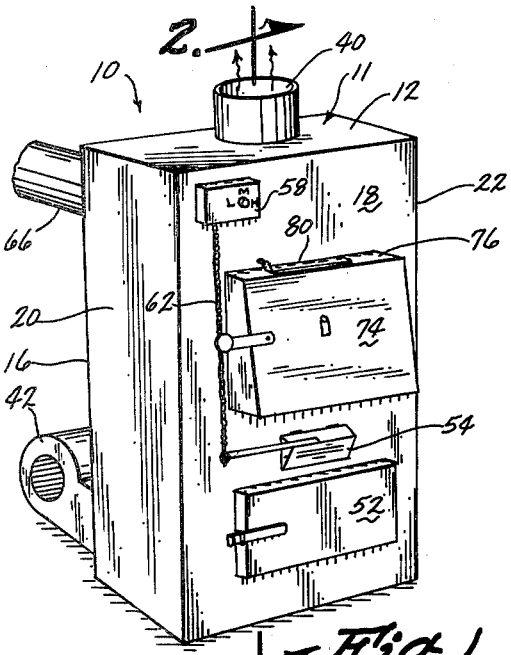
FIG. 1 is a perspective view of the present invention.

Referring to the drawings, the numeral 10 generally designates the wood burning furnace of the present invention. Furnace 10 includes an outer housing 11 comprising a top wall 12, a bottom wall 14, a rear wall 16, a front wall 18, and two lateral walls 20, 22. Within housing 11 is a firebox designated generally by the numeral 24. Firebox 24 includes a top wall 26, a bottom wall 28, a rear wall 30, and lateral side walls 32, 34. The front wall of firebox 24 coincides with front wall 18 of housing 11, but the remainder of the walls 26–34 of firebox 24 are spaced inwardly from the walls of housing 11 so as to define a circulation chamber 36 which surrounds all of walls 26–34 so as to provide a maximum of heat exchange between firebox 24 and the air within circulation chamber 36.

An air inlet opening 38 is provided adjacent the bottom of housing 11 and is in communication with the circulation chamber 36. Adjacent the top of circulation chamber 36 is a hot air discharge opening 40 which permits the exit of air from circulation chamber 36. A fan 42 is connected to air inlet opening 38 for forcing air through circulation chamber 36 and outwardly through hot air discharge opening 40, from which it can be circulated throughout a ventilation system of a building. A thermostat 44 is mounted to the upper portion of housing 11 and is in communication with the interior of circulation chamber 36 so as to be capable of sensing the temperature therein. Thermostat 44 is electrically connected to fan 42, and is adapted to actuate and deactuate fan 42 in response to varying temperatures within circulation chamber 36. It is preferred that the thermostat 44 actuates fan 42 whenever it senses a temperature of approximately 120° and that it deactuates fan 42 whenever it senses a temperature of approximately 100° or less.

Within firebox 24 is a grate 46 which is spaced above bottom wall 28 and which is adapted to support logs 48 for burning. Around the margins of grate 46 are upstanding side walls 50 comprised preferably of fire brick.

Within front wall 18 adjacent the lower portion thereof is an ash pan door 52 which is adapted to be opened to provide access to the space below grate 46 for removal of ashes.

Immediately above ash pan door 52 is a main draft opening 54 which provides communication from the exterior of housing 11 to the interior of the space below grate 46 so as to provide oxygen for the burning wood resting on grate 46. Arrows 56 indicate the flow of air into the space below grate 46.

An automatic draft control 58 is mounted on the outer surface of housing 11 and includes a thermostat 60, preferably of the bi-metal type, adapted to actuate control mechanism 58. Connected to control mechanism 58 is a chain 62 which extends downwardly and is connected to a movable closure (not shown) over draft opening 54, for controlling the size of draft opening 54 and thereby controlling the rate at which combustion takes place within the fire box 24. Draft control 58 is adapted to open and close draft opening 54 varying distances corresponding to the temperature sensed within the upper portion of circulation chamber 36.

A flue opening 64 is provided in upper wall 26 of fire box 24 and is connected to a flue 66 leading to a chimney.

Flue 66 extends through circulation chamber 36 and then outwardly through back wall 16 of housing 11. Thus heat is radiated from flue 66 into circulation chamber 36 so as to increase the efficiency of heat usage.

Positioned within fire box 24 immediately below flue opening 64 is a heat saving baffle 68. Baffle 68 is positioned in spaced relation below flue opening 64 and is horizontally disposed so as to deflect the gases rising from the wood being burned on grate 46. The gases are collected at the area designated by the numeral 70, and then are diverted around the margins of baffle 68 upwardly and outwardly through flue opening 64.

Baffle 68 causes an increased temperature in the vicinity of area 70, and this increased temperature facilitates further combustion of the gases rising from the wood 48 on grate 46. However, in prior devices the lack of availability of sufficient oxygen adjacent the upper portion of the fire box hindered the ability of the gases to be further combusted at the hot spot adjacent area 70.

Figure 6:
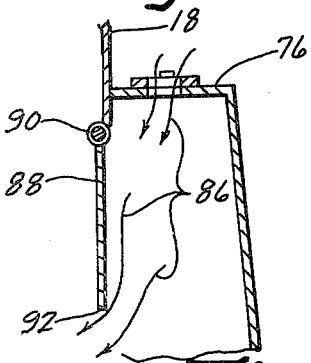
FIG. 6 is a sectional view taken along line 6—6 of FIG. 4.

In order to provide oxygen to area 70 to provide more complete combustion of the gases located at area 70, a secondary draft is provided above grate 46 in the following manner. A door opening 72 is provided in front wall 18 of housing 11. Mounted in covering relation over door opening 72 is a door 74 which is hinged at one lateral edge and which is adapted to be opened to provide access to the interior of fire box 24. Door 74 includes a horizontal upper wall 76 which is provided with a plurality of draft holes 78 providing communication from the exterior of housing 11 through horizontal wall 76 into the interior of fire chamber 24. Mounted for sliding movement over holes 78 is a template plate 80 which has a plurality of openings 82 sized and positioned to correspond in registered alignment over openings 78. A pair of slots 84 are provided in the opposite ends of plate 80 and slidably receive screws 86 which are threadably mounted in wall 76. Slots 84 permit longitudinal sliding movement of plate 80 from a position wherein plate 80 closes opening 78 to a position wherein openings 82 are in registered alignment with holes 78 thereby permitting air to enter holes 78 and gain entrance to fire box 24 as indicated by arrows 86 in FIGS. 2 and 6.

Figure 2:
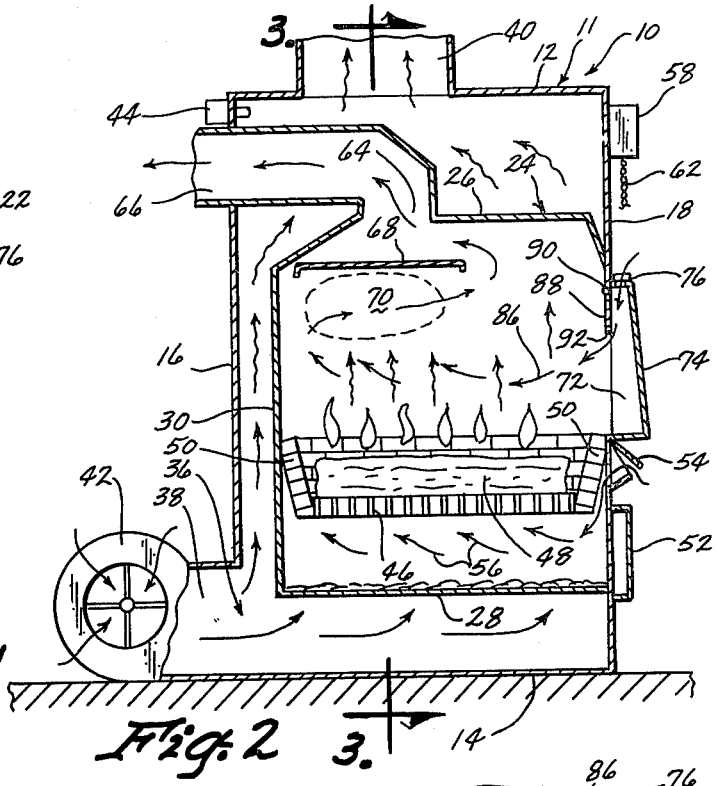
FIG. 2 is a sectional view taken along line 2—2 of FIG. 1.
Figure 3:
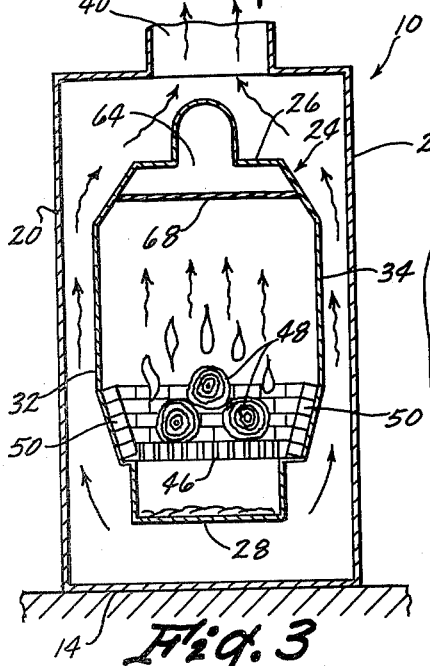
FIG. 3 is a sectional view taken along line 3—3 of FIG. 2.
Figure 4:
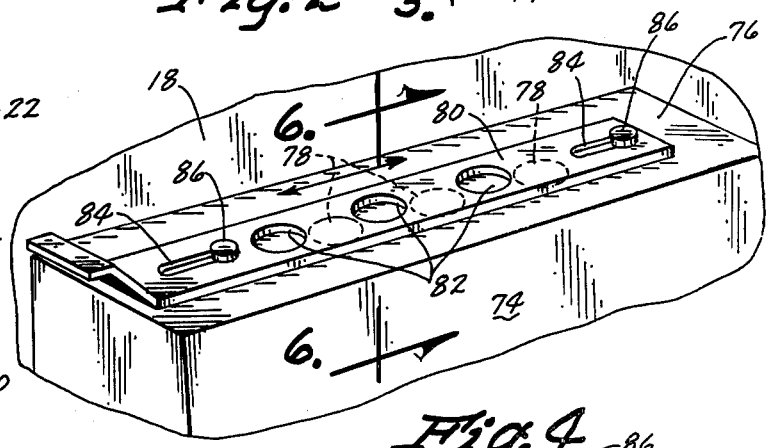
FIG. 4 is an enlarged detailed view of the secondary draft opening and the closure therefor.
Figure 5:
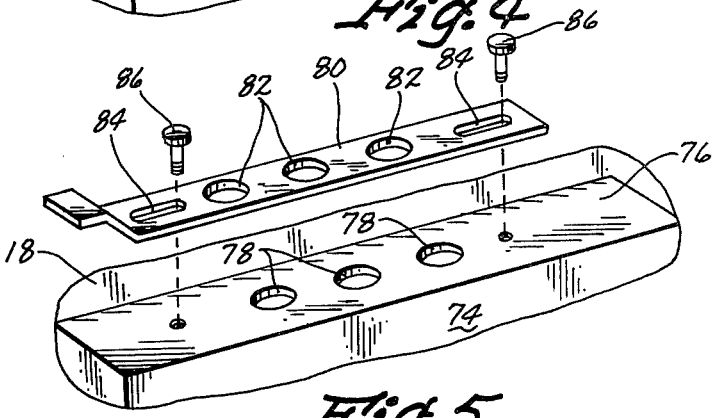
FIG. 5 is a view similar to FIG. 4 but shown in exploded arrangement.

As can be seen in FIG. 2, the rising gases from the burning logs 48 causes the air entering poles 78 to drift upwardly toward baffle 68, thereby introducing oxygen adjacent area 70 for facilitating the further burning of the gases located at area 70. The combination of the increased heat at area 70, together with the introduction of fresh oxygen at area 70, causes the tars and other unburned gases to be more fully combusted than in previous prior art devices.

In order to prevent smoke from existing through holes 78 a smoke damper 88 is provided adjacent the upper margin of door opening 72. Damper 88 is hinged at its upper edge by means of a hinge 90, and extends downwardly therefrom to its lower edge 92. Thus, damper 88 blocks the passage of smoke upwardly and outwardly through holes 78 while at the same time permitting air to enter opening 78 and pass downwardly below the lower edge 92 of damper 88 and thence inwardly to area 70. Hinge 90 permits damper 88 to be folded upwardly out of the way during the insertion of logs through opening 72.

Another advantage achieved by damper 88 is that it causes preheating of the air before the air reaches the interior of firebox 24. This is important in order to prevent the air from lowering the temperature within firebox 24.

The result of the above described structure permits the furnace of the present invention to give more heat and use less wood than other prior art wood stoves or furnaces. The design of the stove also prevents a build-up of pitch in the chimney. It gives more heat than prior art devices with less pitch or soot accumulation in the chimney. Furthermore, the circulation of air around five of the six sides of firebox 24 and also around flue 66 permits a more complete heat exchange to the air being circulated through circulation chamber 36, thereby making the furnace more efficient. Thus, it can be seen that the device accomplishes at least all of its stated objectives.

What is claimed is:

1. A wood burning furnace comprising:

a furnace housing having front and rear walls, opposite side walls, and top and bottom walls, a fire box within said furnace housing having a front wall joined to said front wall of said housing, the remainder of said firebox being spaced inwardly from at least some of said rear, side, top and bottom walls of said housing to define a circulation chamber therebetween whereby air may circulate in said circulation chamber around at least a portion of said firebox;

said top wall of said housing having a hot air exhaust opening in communication with said circulation chamber;

said housing being provided with an air intake opening adjacent the bottom thereof in communication with said circulation chamber;

a flue extending through said housing and being in communication with the interior of said firebox through a flue opening in said firebox;

a heat saving baffle positioned within said firebox below and in spaced relation to said flue opening so as to deflect rising hot air in said firebox and thereby delay said hot air temporarily prior to its exit through said flue opening;

a main draft opening in said firebox adjacent the bottom thereof and providing communication of air from the exterior of said housing to the interior of said firebox;

a secondary draft opening in said firebox above said main draft opening and providing communication of air from the exterior of said housing to the interior of said firebox, the vertical position of said secondary draft being such that fresh air is introduced to the firebox at a point spaced below said baffle sufficient distance to permit said fresh air to mix with and be heated by the hot gases rising within said firebox prior to the time said hot gases are deflected by said baffle.

2. A furnace according to claim 1 wherein said firebox is spaced inwardly from all of said top, bottom, rear, and side walls of said housing wherein said circulation chamber extends above, below, to the rear and to each opposite side of said firebox.

3. A furnace according to claim 1 wherein said front walls of said firebox and said housing are provided with a door opening providing communication from the exterior of said furnace to the interior of said firebox; a door being positioned in covering relation over said door openings; said main draft opening being below said door opening and secondary draft opening being adjacent the upper edge of said door opening.

4. A furnace according to claim 3 wherein a smoke damper is positioned between said secondary draft opening and the interior of said firebox to prevent smoke from exiting said secondary draft opening, said damper having a lower edge below said secondary draft opening whereby air passes from said secondary draft opening below said lower edge of said damper and thence into the interior of said firebox.

5. A furnace according to claim 4 wherein said door opening has an upper edge and said door has an upper edge, said secondary draft opening comprising at least one hole in said door adjacent said upper edge thereof, said damper having an upper edge connected adjacent said upper edge of said door opening.

6. A furnace according to claim 5 wherein said damper is hinged about a horizontal axis adjacent the upper edge thereof whereby said damper may be pivoted inwardly about said horizontal axis during insertion of wood into said firebox through said door opening.

7. A furnace according to claim 6 wherein a draft adjustment means is mounted over said hole in said door, said adjustment means comprising a plate mounted over said hole for sliding movement from a first position exposing said hole to the atmosphere to a second position covering said hole and preventing air from entering said hole.

8. A furnace according to claim 2 wherein a fan is connected to said air intake opening for circulating air through said circulation chamber and outwardly through said hot air exhaust opening, a thermostat positioned within said circulation chamber, and means connecting said thermostat to said fan for controlling the actuation and deactuation of said fan in response to temperature changes within said circulation chamber.

9. A furnace according to claim 8 wherein a draft control means is mounted on said housing and comprises a power means, a chain connected to said power means and a main draft door over said main draft opening, and temperature sensing means within said circulation chamber and responsive to temperature changes within said circulation chamber to actuate and deactuate said power means whereby actuation of said power means causes said chain to move said main draft door for controlling the amount of air permitted to enter said main draft opening.

10. A wood burning furnace comprising:

a furnace housing having a firebox therein, said firebox having upper and lower ends, a flue opening in said firebox adjacent said upper end thereof;

a flue extending through said housing and being in communication with the interior of said firebox through said flue opening;

a grate within said firebox and spaced downwardly from said upper end of said firebox for supporting burning fuel whereby the heated gases from said burning fuel will rise and exit from said firebox through said flue opening;

a main draft opening in said housing positioned to provide communication of air from the exterior of said housing to the interior of said firebox adjacent said grate;

a heat saving baffle within said housing and positioned in spaced relation below said flue opening and spaced relation above said grate so as to deflect rising partially combusted gases and thereby delay their exit through said flue opening;

a secondary draft opening within said housing positioned in spaced relation above said grate and spaced relation below said baffle whereby the venturi effect of said rising gases will draw fresh air into said firebox through said secondary draft opening and will mix with and preheat said fresh air prior to the time said rising gases are delayed by said baffle.

11. A furnace according to claim 10 wherein a smoke damper is positioned between said secondary draft opening and the interior of said firebox to prevent smoke from exiting said secondary draft opening, said damper having a lower edge below said secondary draft opening whereby air passes from said secondary draft opening below said lower edge of said damper and thence into the interior of said firebox.

* * * * *